US010239651B2

(12) United States Patent
Exner et al.

(10) Patent No.: US 10,239,651 B2
(45) Date of Patent: Mar. 26, 2019

(54) CARTON WITH TOP CLOSURE

(71) Applicant: Graphic Packaging International, LLC, Atlanta, GA (US)

(72) Inventors: Dana Exner, Elmwood Park, IL (US); Gary Lenkeit, Wheaton, IL (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/865,771

(22) Filed: Jan. 9, 2018

(65) Prior Publication Data

US 2018/0201403 A1 Jul. 19, 2018

Related U.S. Application Data

(60) Provisional application No. 62/445,990, filed on Jan. 13, 2017.

(51) Int. Cl.

| | |
|---|---|
| ***B65D 5/06*** | (2006.01) |
| ***B31B 50/26*** | (2017.01) |
| ***B31B 100/00*** | (2017.01) |
| ***B31B 110/35*** | (2017.01) |

(52) U.S. Cl.

CPC ..... *B65D 5/061* (2013.01); *B31B 50/262* (2017.08); *B31B 2100/002* (2017.08); *B31B 2110/35* (2017.08)

(58) Field of Classification Search

CPC ..... B65D 5/061; B65D 5/067; B65D 5/10; B31B 50/262

USPC ..... 229/126, 149, 137; 53/456, 467, 491

See application file for complete search history.

(56) References Cited

U.S. PATENT DOCUMENTS

| | | | |
|---|---|---|---|
| 83,812 | A | 11/1868 | Wilcox |
| 362,583 | A | 5/1887 | Jordan |
| 567,649 | A | 9/1896 | Lanzit |
| 1,082,868 | A | 12/1913 | Hollett |

(Continued)

FOREIGN PATENT DOCUMENTS

| | | | |
|---|---|---|---|
| CH | 412 695 | A | 4/1966 |
| DE | 29 23 455 | A1 | 12/1980 |

(Continued)

OTHER PUBLICATIONS

International Search Report and Written Opinion for PCT/US2018/012917 dated Apr. 25, 2018.

(Continued)

*Primary Examiner* — Christopher Demeree

(74) *Attorney, Agent, or Firm* — Womble Bond Dickinson (US) LLP

(57) ABSTRACT

A carton for holding at least one article includes a plurality of panels that extends at least partially around an interior of the carton. The plurality of panels includes a front panel, a first side panel, a second side panel, and a back panel. A plurality of end flaps includes a first end flap foldably connected to the front panel and a second end flap foldably connected to the back panel. A first gusset is foldably connected to a portion of the first side panel and a second gusset is foldably connected to a portion of the second side panel. At least the first end flap, the first gusset, and the second gusset cooperate to form a first closure of the carton, and the second end flap forms a second closure of the carton. The second closure at least partially overlaps the first closure.

36 Claims, 8 Drawing Sheets

(56) References Cited

U.S. PATENT DOCUMENTS 1,772,625 A 8/1930 Caulfield
1,837,750 A 12/1931 Becker
1,842,237 A 1/1932 Becker
1,907,067 A 5/1933 Harmann
1,973,960 A 9/1934 McLaughlin
1,998,717 A 4/1935 Guyer
2,010,863 A 8/1935 Johnson
2,114,623 A 4/1938 Bergstein
2,192,722 A 3/1940 Vogt
2,355,665 A 8/1944 Mabee
2,361,984 A 11/1944 Williamson
2,475,677 A 7/1949 Ringler
2,509,289 A 5/1950 Dunning
2,634,897 A 4/1953 Bord
2,683,953 A 7/1954 Hopkins
2,701,678 A 2/1955 Read
2,738,916 A 3/1956 Peters
2,750,096 A 6/1956 Misch
2,757,851 A 8/1956 Moore
2,778,557 A 1/1957 Moore
2,820,585 A 1/1958 Nerenberg et al.
2,950,036 A 8/1960 Vergobbi
2,982,461 A 5/1961 Hultin
2,989,224 A 6/1961 Umanoff
3,022,930 A * 2/1962 Kuchenbecker ..... B65D 5/062 229/117.12
3,040,950 A * 6/1962 Kuchenbecker ..... B65D 5/062 229/214
3,040,951 A * 6/1962 Kuchenbecker ..... B65D 5/062 229/214
3,085,733 A 4/1963 Umanoff
3,127,082 A 3/1964 Meyer-Jagenberg
3,133,688 A 5/1964 Asman
3,300,115 A 1/1967 Schauer
3,306,514 A * 2/1967 MacKendrick ..... B65D 5/745 229/219
3,347,446 A 10/1967 Guyer et al.
3,355,089 A 11/1967 Champlin
3,363,822 A 1/1968 Maulini et al.
3,426,955 A 2/1969 Olson
3,484,034 A 12/1969 Sternau
3,580,483 A 5/1971 Young
3,587,944 A 6/1971 Pehr
3,591,069 A 7/1971 Heller et al.
3,605,578 A 9/1971 Sternau
3,640,447 A 2/1972 Forbes et al.
3,669,345 A 6/1972 Cote
3,680,766 A 8/1972 Collura et al.
3,690,544 A 9/1972 Meyers
3,764,058 A 10/1973 Forbes, Jr.
3,768,719 A 10/1973 Johnson
3,924,800 A * 12/1975 Desmond ..... B65D 5/10 206/807
4,094,456 A 6/1978 Raccaforte
4,138,016 A 2/1979 Roccaforte
4,141,485 A 2/1979 Lambert
4,150,778 A 4/1979 Engdahl, Jr.
4,168,003 A 9/1979 Wysocki
4,194,677 A 3/1980 Wysocki
4,201,329 A 5/1980 Roccaforte
4,228,898 A 10/1980 Zeitter et al.
4,252,267 A 2/1981 Osborne
4,313,553 A 2/1982 Lisiecki
4,344,537 A 8/1982 Austin
4,361,270 A 11/1982 Roccaforte
4,411,365 A 10/1983 Horikawa et al.
4,484,683 A 11/1984 Werner, Jr.
4,508,218 A 4/1985 Focke et al.
4,558,785 A 12/1985 Gordon
4,565,315 A 1/1986 Wagner et al.
4,609,142 A 9/1986 Adamek
4,645,108 A 2/1987 Gavin et al.
4,676,394 A 6/1987 Hiersteiner
4,762,234 A 8/1988 Wyberg
4,782,788 A 11/1988 Arcand
4,905,898 A 3/1990 Wade
4,913,292 A 4/1990 Field
4,953,781 A 9/1990 Bryan
5,014,888 A 5/1991 Bryan
5,031,825 A 7/1991 Romagnoli
5,056,708 A 10/1991 Boyle et al.
5,060,852 A 10/1991 Beckerman et al.
5,078,273 A 1/1992 Kuchenbecker
5,107,120 A 4/1992 Tom
5,110,042 A 5/1992 Hurden
5,141,150 A 8/1992 Plaessman
5,147,272 A 9/1992 Richison et al.
5,147,480 A 9/1992 Lang
5,160,307 A 11/1992 Bacques et al.
5,166,681 A 11/1992 Bottesch et al.
5,215,250 A 6/1993 Roccoforte
5,222,660 A 6/1993 Koss
5,230,463 A * 7/1993 Brauner ..... B65D 5/6602 229/138
5,251,808 A 10/1993 Rudd
5,255,494 A 10/1993 Doyle
5,292,058 A 3/1994 Zoss et al.
5,326,024 A 7/1994 Fogle
5,347,865 A 9/1994 Mulry et al.
5,372,301 A 12/1994 Besson
5,373,960 A 12/1994 Gunn et al.
5,429,297 A 7/1995 Walsh
5,445,316 A 8/1995 Roccaforte
5,463,384 A 10/1995 Juds
5,501,394 A 3/1996 Eno
5,505,374 A 4/1996 Stone
5,515,996 A 5/1996 Stone
5,632,402 A 5/1997 Walsh
5,632,404 A 5/1997 Walsh
5,642,599 A 7/1997 Tisma
5,660,324 A 8/1997 Rowland
5,668,539 A 9/1997 Patchell
5,678,755 A 10/1997 Block
5,680,986 A 10/1997 Botterman
5,746,871 A 5/1998 Walsh
5,783,030 A 7/1998 Walsh
5,788,102 A 8/1998 Hall et al.
5,794,811 A 8/1998 Walsh
5,794,812 A 8/1998 Walsh
5,816,487 A 10/1998 Skinner
5,819,924 A 10/1998 Sigrist et al.
5,857,614 A 1/1999 Walsh
5,875,963 A 3/1999 Stone et al.
5,876,317 A 3/1999 Sigrist et al.
5,911,359 A 6/1999 Stone et al.
5,918,799 A 7/1999 Walsh
5,988,494 A 11/1999 Fontaine
5,992,734 A 11/1999 Tokarski et al.
5,996,882 A 12/1999 Randall
6,050,484 A * 4/2000 Galomb ..... B65D 5/701 229/213
6,059,182 A 5/2000 Wein
6,062,467 A 5/2000 Ours et al.
6,102,277 A 8/2000 Krapohl, Sr.
6,109,517 A 8/2000 Cabrera
6,120,184 A 9/2000 Laurence et al.
6,145,736 A 11/2000 Ours et al.
6,152,360 A 11/2000 Block et al.
6,164,821 A 12/2000 Randall
6,195,959 B1 3/2001 Tisma
6,206,279 B1 3/2001 Countee
6,213,388 B1 4/2001 Ours et al.
6,223,507 B1 5/2001 Tisma
6,227,440 B1 5/2001 Hart
6,328,472 B1 12/2001 Laurence et al.
6,336,584 B1 1/2002 Roch et al.
6,352,096 B1 3/2002 Walsh
6,364,202 B1 4/2002 Zelley
6,386,438 B1 5/2002 Walsh et al.
6,419,151 B1 7/2002 Urtubey
6,424,272 B1 7/2002 Gutta et al.
6,478,216 B2 11/2002 Wiart
6,676,009 B1 1/2004 Rose

(56) References Cited

U.S. PATENT DOCUMENTS

| | | | |
|---|---|---|---|
| 6,753,766 | B2 | 6/2004 | Patchell |
| 6,854,639 | B2 | 2/2005 | Walsh |
| 6,929,172 | B2 | 8/2005 | Bates et al. |
| 6,961,006 | B2 | 11/2005 | Harter, Jr. et al. |
| 7,025,504 | B2 | 4/2006 | Olin |
| 7,036,714 | B2 | 5/2006 | Walsh et al. |
| 7,148,482 | B2 | 12/2006 | Harter, Jr. |
| 7,210,612 | B2 | 5/2007 | Walsh et al. |
| 7,253,722 | B2 | 8/2007 | Deasy et al. |
| 7,331,509 | B2 | 2/2008 | Bates et al. |
| 7,617,969 | B2 | 11/2009 | Oliveira |
| 7,690,554 | B2 | 4/2010 | Zacher et al. |
| 7,731,080 | B2 | 6/2010 | Zacher et al. |
| 7,913,897 | B2 | 3/2011 | Manaige |
| 7,971,773 | B2 | 7/2011 | Wagner et al. |
| 7,984,844 | B2 | 7/2011 | Jones |
| 8,672,214 | B2 | 3/2014 | Manaige |
| 8,770,469 | B2 | 7/2014 | Burke et al. |
| 8,950,657 | B2 | 2/2015 | Wagner |
| 9,346,582 | B2 | 5/2016 | Pinkstone |
| 2001/0025877 | A1 | 10/2001 | Ryan |
| 2001/0048022 | A1 | 12/2001 | Zoeckler |
| 2002/0055429 | A1 | 5/2002 | Walsh |
| 2003/0057266 | A1 | 3/2003 | Sedo |
| 2003/0144121 | A1 | 7/2003 | Walsh et al. |
| 2004/0102748 | A1 | 5/2004 | Hirotsu |
| 2004/0112948 | A1 | 6/2004 | Bone |
| 2004/0226989 | A1 | 11/2004 | Cook et al. |
| 2005/0127150 | A1 | 6/2005 | Walsh et al. |
| 2005/0187087 | A1 | 8/2005 | Walsh |
| 2005/0199695 | A1 | 9/2005 | DeBusk et al. |
| 2005/0209576 | A1 | 9/2005 | Hirotsu |
| 2005/0211903 | A1 | 9/2005 | Harter, Jr. |
| 2005/0224564 | A1 | 10/2005 | Walsh |
| 2005/0274086 | A1 | 12/2005 | Petrelli et al. |
| 2005/0274782 | A1 | 12/2005 | Petrelli et al. |
| 2006/0054675 | A1 | 3/2006 | Bennett |
| 2006/0067378 | A1 | 3/2006 | Rege et al. |
| 2006/0243783 | A1 | 11/2006 | Spivey, Sr. et al. |
| 2006/0255106 | A1 | 11/2006 | Green |
| 2006/0255107 | A1 | 11/2006 | Wright |
| 2006/0255109 | A1 | 11/2006 | Green |
| 2006/0255113 | A1 | 11/2006 | McGowan |
| 2007/0131752 | A1 | 6/2007 | Jones |
| 2007/0152028 | A1 | 7/2007 | McGowan |
| 2007/0194093 | A1 | 8/2007 | Ford |
| 2008/0135605 | A1 | 6/2008 | Manaige |
| 2008/0296360 | A1 | 12/2008 | Abel et al. |
| 2010/0043360 | A1 | 2/2010 | DeBusk et al. |
| 2010/0108749 | A1 | 5/2010 | House |
| 2010/0127057 | A1 | 5/2010 | Burke |
| 2010/0127061 | A1 | 5/2010 | Burke et al. |
| 2012/0138667 | A1 | 6/2012 | Burke et al. |
| 2015/0368019 | A1 | 12/2015 | Pinkstone |
| 2017/0113832 | A1 | 4/2017 | Faulkner |
| 2017/0225822 | A1 | 8/2017 | Cooper et al. |

FOREIGN PATENT DOCUMENTS

| | | | |
|---|---|---|---|
| DE | 81 10 323.9 | | 9/1981 |
| DE | 3307758 | A | 9/1984 |
| DE | 87 08 078.8 | | 10/1987 |
| DE | 43 08 047 | A1 | 12/1993 |
| DE | 93 20 241.5 | | 3/1994 |
| DE | 94 13 813 | U1 | 10/1994 |
| EP | 0 466 337 | A2 | 1/1992 |
| EP | 0 529 260 | A2 | 3/1993 |
| EP | 0 530 643 | A2 | 3/1993 |
| EP | 1 457 425 | A1 | 9/2004 |
| EP | 1 562 053 | A2 | 8/2005 |
| EP | 1 580 542 | A2 | 9/2005 |
| FR | 2 699 150 | | 6/1994 |
| FR | 2 755 670 | | 5/1998 |
| GB | 104445 | | 3/1917 |
| GB | 385 033 | A | 12/1932 |
| GB | 1 242 356 | | 8/1971 |
| GB | 1 489 963 | | 10/1977 |
| GB | 1 584 066 | | 2/1981 |
| GB | 2 296 706 | A | 7/1996 |
| GB | 2 363 372 | A | 12/2001 |
| KR | 20-1998-0019535 | | 7/1998 |
| KR | 10-0211329 | | 8/1999 |
| KR | 10-0354924 | | 10/2002 |
| KR | 10-2004-0004669 | | 1/2004 |
| KR | 10-2005-0013599 | | 2/2005 |
| WO | WO 95/28325 | | 10/1995 |
| WO | WO 99/38779 | | 8/1999 |
| WO | WO 00/74931 | A1 | 12/2000 |
| WO | WO 02/04302 | A1 | 1/2002 |
| WO | WO 2006/124643 | A1 | 11/2006 |
| WO | WO 2006/133401 | A2 | 12/2006 |
| WO | WO 2007/050722 | A1 | 5/2007 |
| WO | WO 2009/018400 | A2 | 2/2009 |

OTHER PUBLICATIONS

Third Party Observation filed in PCT/US2018/012917 dated Aug. 2, 2018.

* cited by examiner

CARTON WITH TOP CLOSURE

CROSS-REFERENCE TO RELATED APPLICATION

This application claims the benefit of U.S. Provisional Patent Application No. 62/445,990, filed on Jan. 13, 2017.

INCORPORATION BY REFERENCE

The disclosure of U.S. Provisional Patent Application No. 62/445,990, which was filed on Jan. 13, 2017, is hereby incorporated by reference for all purposes as if presented herein in its entirety.

BACKGROUND OF THE DISCLOSURE

The present disclosure relates to cartons, blanks for forming cartons, and methods associated with cartons and blanks for holding and carrying at least one article. In one embodiment, the present disclosure relates to a carton having a gable top with a sift-minimizing top closure configuration.

SUMMARY OF THE DISCLOSURE

According to one aspect of the disclosure, a carton for holding at least one article, the carton comprises a plurality of panels, a plurality of panels, a first gusset, and a second gusset. The plurality of panels extends at least partially around an interior of the carton, the plurality of panels comprises a front panel, a first side panel, a second side panel, and a back panel. The plurality of end flaps is foldably connected to respective panels of the plurality of panels, the plurality of end flaps comprises a first end flap foldably connected to the front panel and a second end flap foldably connected to the back panel. The first gusset is foldably connected to a portion of the first side panel and the second gusset is foldably connected to a portion of the second side panel. At least the first end flap, the first gusset, and the second gusset cooperate to form a first closure of the carton, and the second end flap forms a second closure of the carton, the second closure at least partially overlaps the first closure.

According to another aspect of the disclosure, a blank for forming a carton for holding at least one article comprises a plurality of panels, a plurality of end flaps, a first gusset, and a second gusset. The plurality of panels is for extending at least partially around an interior of the carton formed from the blank, the plurality of panels comprises a front panel, a first side panel, a second side panel, and a back panel. The plurality of end flaps is foldably connected to respective panels of the plurality of panels, the plurality of end flaps comprises a first end flap foldably connected to the front panel and a second end flap foldably connected to the back panel. The first gusset is foldably connected to a portion of the first side panel and the second gusset is foldably connected to a portion of the second side panel. At least the first end flap, the first gusset, and the second gusset are for cooperating to form a first closure of the carton formed from the blank, and the second end flap is for forming a second closure of the carton formed from the blank, the second closure is for at least partially overlapping the first closure of the carton formed from the blank.

According to another aspect of the disclosure, a method of forming a carton for holding at least one article comprises obtaining a blank. The blank comprises a plurality of panels and a plurality of end flaps, the plurality of panels comprises a front panel, a first side panel, a second side panel, and a back panel, and the plurality of end flaps are foldably connected to respective panels of the plurality of panels. The plurality of end flaps comprises a first end flap foldably connected to the front panel and a second end flap foldably connected to the back panel. The blank further comprises a first gusset foldably connected to a portion of the first side panel and a second gusset foldably connected to a portion of the second side panel. The method further comprises folding the plurality of panels to at least partially extend around an interior of the carton. The method further comprises positioning the first end flap, the first gusset, and the second gusset to form a first closure of the carton. The method further comprises positioning the second end flap to form a second closure of the carton, the second closure at least partially overlaps the first closure.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

Cartons according to the present disclosure can accommodate articles of numerous different shapes. For the purpose of illustration and not for the purpose of limiting the scope of the disclosure, the following detailed description describes articles such as food products at least partially disposed within the carton embodiments.

In this specification, the terms "lower," "bottom," "upper", "top", "front", and "back" indicate orientations determined in relation to fully erected cartons. Further, as described herein, cartons may be formed from blanks by overlapping multiple panels and/or end flaps. Such panels and/or end flaps may be designated herein in terms relative to one another, e.g., "first", "second", "third", etc., in sequential or non-sequential reference, without departing from the disclosure.

Figure 1:
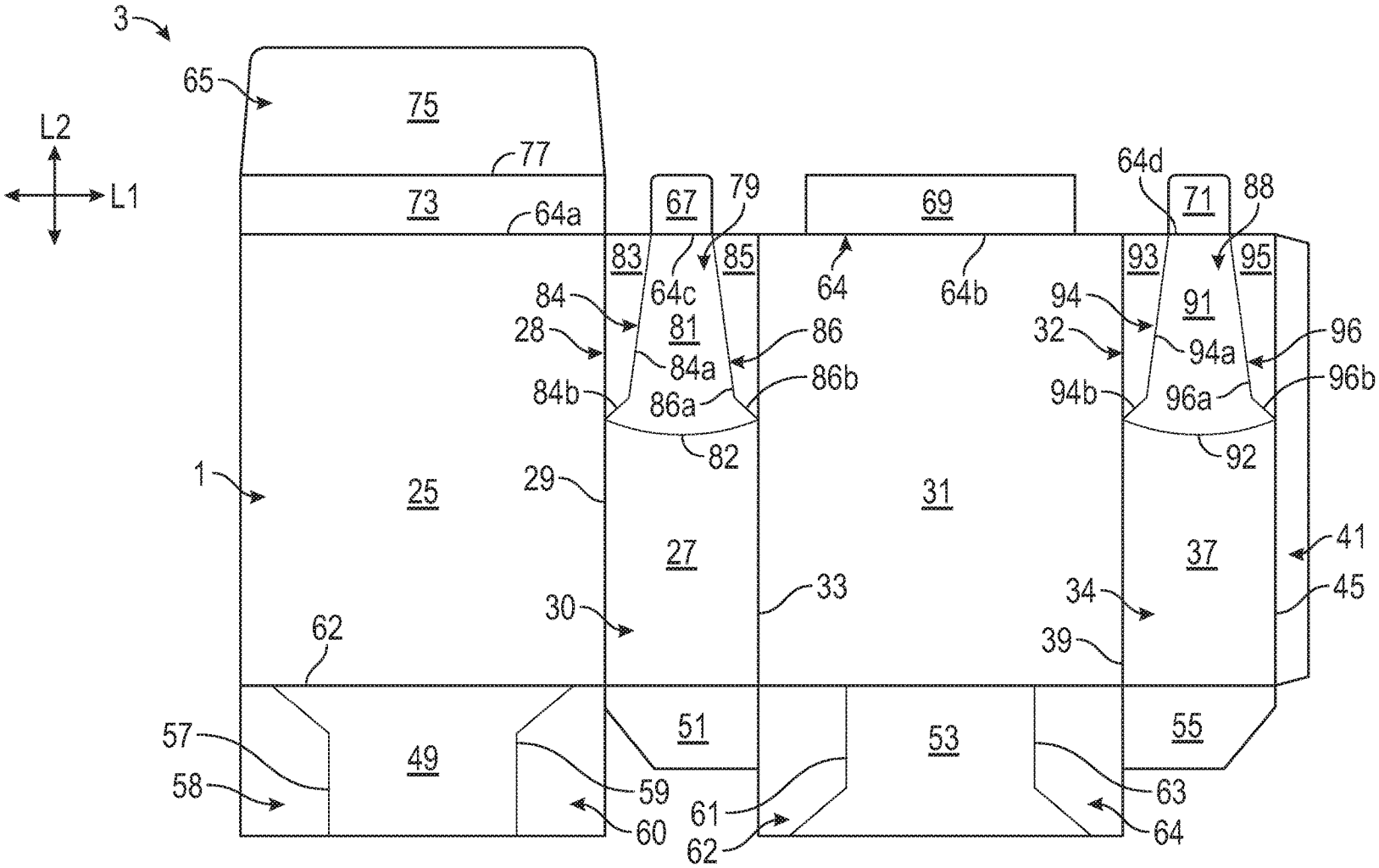
FIG. 1 is a plan view of an exterior surface of a blank for forming a carton according to one exemplary embodiment of the disclosure.
Figure 7:
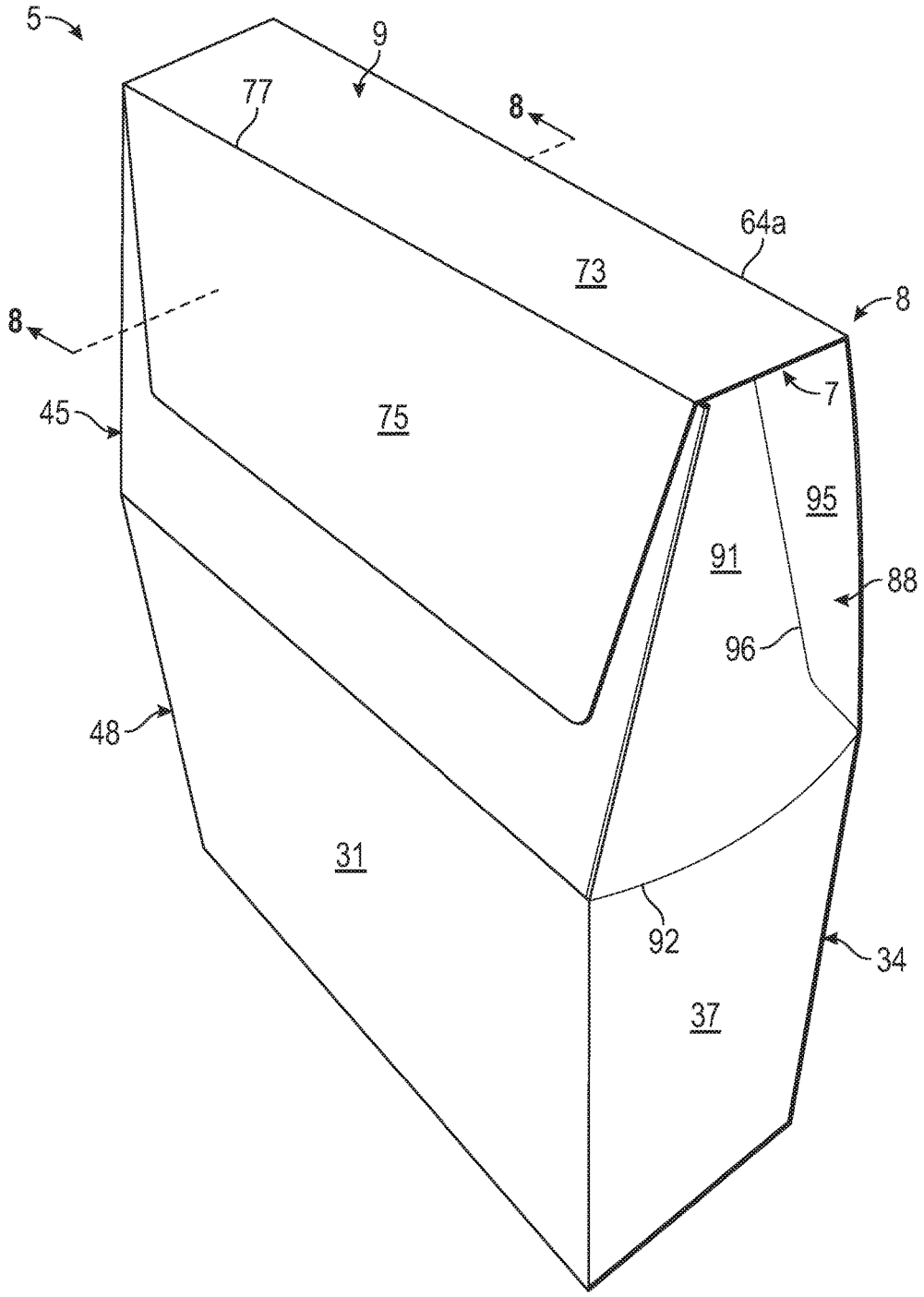
FIG. 7 is a fourth sequential view of the carton of FIG. 2 during a closing operation according to one exemplary embodiment of the disclosure.

FIG. 1 is a plan view of an exterior surface 1 of a blank 3 that can be obtained and used to form a carton 5 (FIG. 3) according to one exemplary embodiment of the disclosure. The carton 5 can be used to hold at least one article or a plurality of articles such as food products P (FIG. 3), e.g., pasta, cereal, candy, energy bars, granola bars, dairy bars, or any other food product such as beverage products, liquid or dry product (such as laundry detergent or cosmetics), and/or any other article or product. In one embodiment, the food product P can be a flowable product. As shown in FIG. 7, the carton 5 has a gable top 8, e.g., a top portion that has a tapered and/or gable-type configuration that is configured to seal the carton 5 and contain the food product P in the carton 5. The carton 5 can include various dispensing features and various handle features without departing from the disclosure.

The blank 3, as shown, has a longitudinal axis L1 and a lateral axis L2. The blank 3 includes a back panel 25 foldably connected to a first side panel 27 at a lateral fold line 29. A front panel 31 is foldably connected to the first side panel 27 at a lateral fold line 33. A second side panel 37 is foldably connected to the front panel 31 at a lateral fold line 39. An adhesive flap 41 is foldably connected to the second side panel 37 at a lateral fold line 45.

As shown in FIG. 1, respective bottom end flaps 49, 51, 53, 55 are foldably connected to the respective back panel 25, the first side panel 27, the front panel 31, and the second side panel 37. The bottom end flaps 49, 51, 53, 55 are foldably connected to respective panels 25, 27, 31, 37 at a marginal portion of the blank 3 by a longitudinal fold line 62. The fold line 62 can be otherwise shaped or be offset at portions of the blank 3 without departing from the disclosure. Further, the bottom end flaps 49, 51, 53, 55 have features for facilitating at least partial overlapping of the end flaps 49, 51, 53, 55 to form a closed bottom 11 (FIG. 3) of the carton 5. As shown, the bottom end flap 49 can include a pair of respective deboss lines 57, 59 that define respective deboss regions 58, 60 on the bottom end flap 49 and the bottom end flap 53 can include a pair of respective emboss lines 61, 63 that define respective emboss regions 62, 64 on the bottom end flap 53. The end flaps 49, 51, 53, 55 could be otherwise shaped, arranged, and/or configured, for example, including differently-shaped or arranged surface features, without departing from the disclosure.

As also shown in FIG. 1, respective top end flaps 65, 67, 69, 71 are foldably connected to the respective back panel 25, the first side panel 27, the front panel 31, and the second side panel 37 at a marginal portion of the blank 3 at portions of a longitudinal fold line 64. The fold line 64 can be otherwise shaped or be offset at portions of the blank 3 without departing from the disclosure. Further, the top end flaps 65, 67, 69, and 71 have features for facilitating at least partial overlapping of the end flaps 65, 67, 69, and 71 to form the gable top 8 of the carton 5 (FIG. 7). As shown, the top end flap 65 includes a proximal portion 73 foldably connected to the back panel 25 at a portion 64*a* of the longitudinal fold line 64, and a distal portion 75 foldably connected to the proximal portion 73 at a longitudinal fold line 77. The end flap 69 is foldably connected to front panel 31 at a portion 64*b* of the longitudinal fold line 64. The end flaps 65, 67, 69, and 71 could be otherwise shaped, arranged, and/or configured without departing from the disclosure.

In the illustrated embodiment, the blank 3 includes a first gusset 79 comprising an upper portion 28 of the first side panel 27. The first gusset 79 includes a central or first gusset panel 81 foldably connected to a second gusset panel 83 and a third gusset panel 85 at respective fold lines 84, 86. As shown, the fold line 84 includes a first oblique portion 84*a* intersecting a second oblique portion 84*b*, and the fold line 86 includes a first oblique portion 86*a* intersecting a second oblique portion 86*b*. The first oblique portion 84*a* can intersect the second oblique portion 84*b* at an angle, for example, an obtuse angle, and the first oblique portion 86*a* can intersect the second oblique portion 86*b* at an angle, for example, an obtuse angle. The central gusset panel 81 is also foldably connected to a lower portion 30 of the first side panel 27 at a fold line 82 that intersects and interconnects the respective second oblique portions 84*b*, 86*b* of the respective fold lines 84, 86. The first gusset 79 could have other features and could be otherwise shaped, arranged, and/or configured, without departing from the scope of the disclosure.

As shown, a second gusset 88 comprises an upper portion 32 of the second side panel 37, and has similar features as the first gusset 79, as shown. In particular, the second gusset 88 includes a central or fourth gusset panel 91 foldably connected to fifth and sixth gusset panels 93, 95 at respective fold lines 94, 96 having respective first and second oblique portions 94*a*, 94*b* and 96*a*, 96*b*. The central gusset panel 91 is foldably connected to a lower portion 34 of the second side panel 37 at a curved fold line 92 that intersects and interconnects the respective second oblique portions 94*b*, 96*b* of the respective fold lines 94, 96. The central gusset panels 81, 91 are connected to a respective end flap 67, 71 at respective portions 64*c*, 64*d* of the longitudinal fold line 64. The gussets 79, 88 could be otherwise shaped, arranged, configured, and/or oriented without departing from the disclosure.

In this regard, the first and second gussets 79, 88 each include respective panels 81, 83, 85 and 91, 93, 95 that are configured for movement relative to one another to facilitate formation of the gable top 8 (FIG. 7), as described herein.

Figure 2:
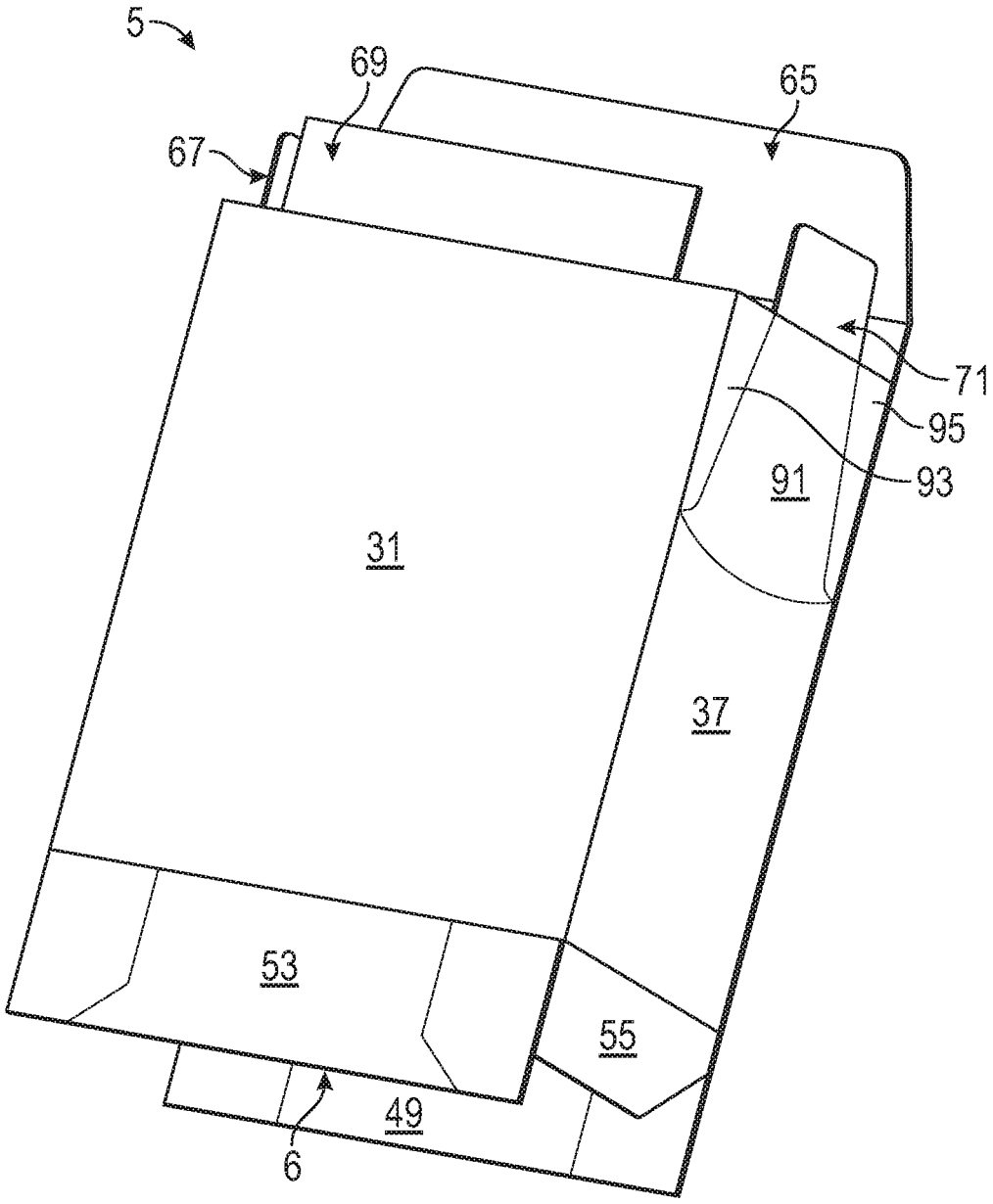
FIG. 2 is a perspective view of a partially-assembled configuration of a carton formed from the blank of FIG. 1 according to one exemplary embodiment of the disclosure.

Referring additionally to FIG. 2, in accordance with one exemplary embodiment, the carton 5 is formed from the blank 3 by folding the respective panels 25, 27, 31, 37 at respective fold lines 29, 33, 39 to at least partially extend around an interior 6 of the carton 5. The adhesive flap 41 can be folded about the fold line 45 and adhered to the back panel 25 to maintain the carton 5 in the illustrated open-ended sleeve configuration.

Figure 3:
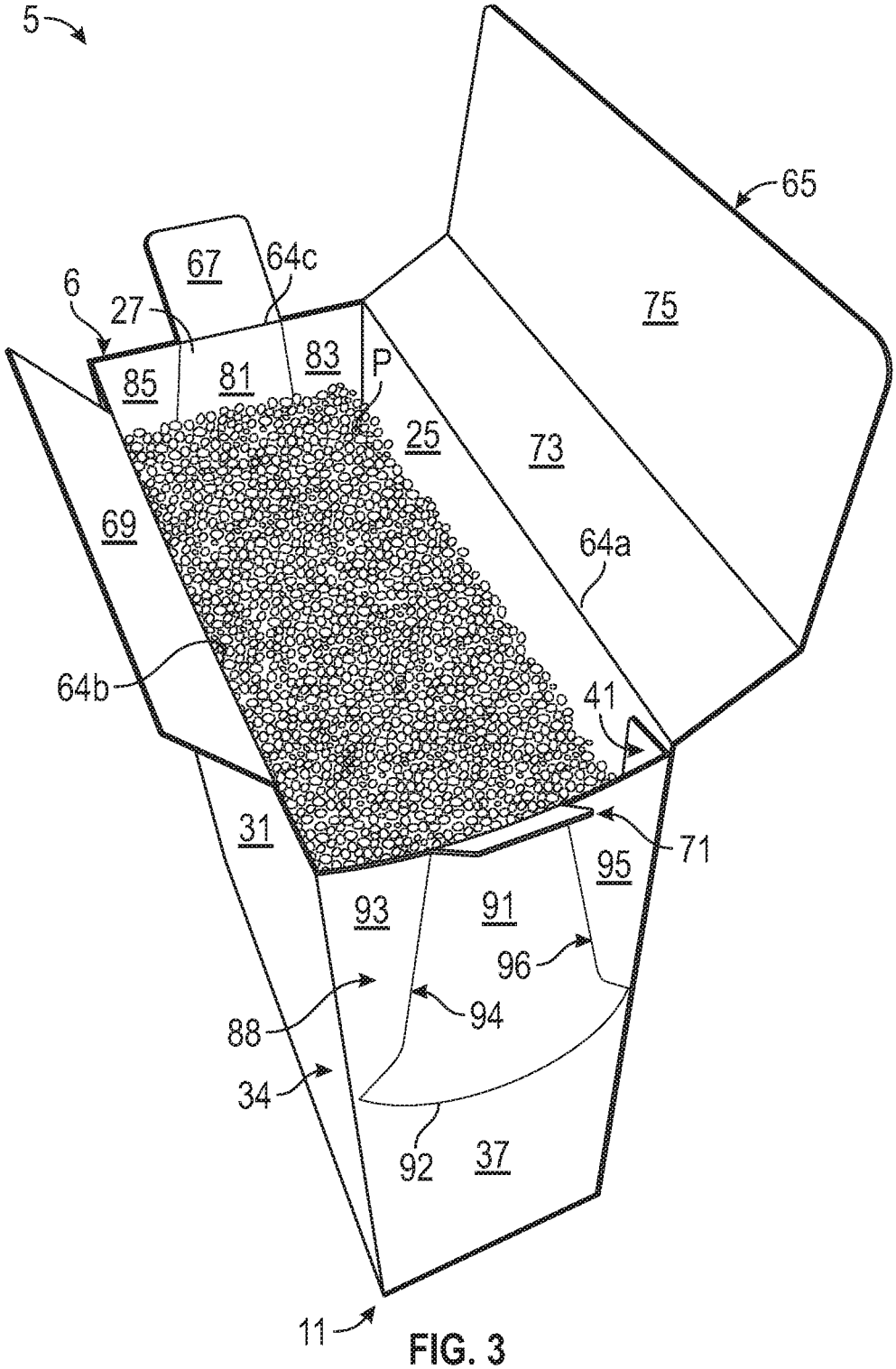
FIG. 3 is a perspective view of a carton formed from the blank of FIG. 1 according to one exemplary embodiment of the disclosure and in a partially-open configuration.

Referring additionally to FIG. 3, the bottom 11 of the carton 5 can be closed by folding the bottom end flaps 49, 51, 53, 55 at respective portions of the fold line 62 toward the interior 6 of the carton 5 and overlapping the bottom end flaps 49, 51, 53, 55, one or more of which can be positioned into face-to-face contact. In the exemplary embodiment shown, the bottom end flaps 49, 53 can be positioned in overlapping relation, for example, at least partial face-to-face contact, with the bottom end flaps 51, 55 disposed therebetween. In particular, the bottom end flap 51 can be positioned in overlapping relation between the bottom end flaps 49, 53 and in substantial alignment with each of the deboss region 60 and the emboss region 62 such that the bottom end flap 51 is in at least partial face-to-face contact with each of the bottom end flaps 49, 53. Further, the bottom end flap 55 can be positioned in overlapping relation between the bottom end flaps 49, 53 and in substantial alignment with each of the deboss region 58 and the emboss region 64 such that the bottom end flap 55 is in at least partial face-to-face contact with each of the bottom end flaps 49, 53. In this regard, the emboss region 62 and the deboss region 60 can be provided to accommodate the positioning of the bottom end flap 51 therebetween, and the emboss region 64 and the deboss region 58 can be provided to accommodate the positioning of the bottom end flap 55 therebetween. One or more of the bottom end flaps 49, 51, 53, 55 can be adhesively secured, for example, with glue, without departing from the disclosure. Such an arrangement of the bottom end flaps 49, 51, 53, 55 can provide a substantially sift-minimizing or sift-proof configuration to the bottom 11 of the carton 5, which can inhibit, minimize, and/or prevent the passage of flowable products P (FIG. 3) stored in the interior 6 of the carton 5 or associated particulate, as described further herein. The bottom 11 of the carton 5 can also be provided in a substantially sealed, e.g., hermetically sealed, arrangement in the configuration described above, or in a different configuration, without departing from the disclosure.

The above-described formation of the carton 5 into the illustrated open-top configuration can be accomplished, for example, with a packaging system that can comprise different stations, modules, or components, such as a carton forming station, a wrapping station, a pick and place station, a closing or sealing station, or any other suitable station or components. The blank 3 can be formed into the carton 5 by other packaging systems without departing from the disclosure. As shown, the interior 6 of the carton 5 can be loaded with articles, such as flowable products P, as shown, by a suitable packaging or handling system (not shown) or, in other embodiments, can be manually loaded with articles.

Still referring to FIG. 1, and referring additionally to FIGS. 4-7, the gable top 8 of the carton 5 can be closed by activating the gussets 79, 88 to position the respective central gusset panels 81, 91 inwardly toward the interior 6 of the carton 5 such that the second and third gusset panels 83, 85 and the fifth and sixth gusset panels 93, 95 are obliquely disposed relative to the respective back and front panels 25, 31. As shown, the respective central gusset panels 81, 91 may be moved inwardly toward the interior 6 of the carton 5 respective longitudinal distances D1 and D2. As shown, the end flap 69 may have a longitudinal length, e.g., width, defined by and/or substantially equal to a distance D3 and the front panel 31 can have a longitudinal length defined by and/or substantially equal to a distance D4 such that the sum of D1, D2, and D3 is substantially equal to D4. The distances D1 and D2 can be substantially similar, or, in one embodiment, may be different.

As shown, upon activation of the gussets 79, 88, respective top portions 43, 45 of the respective back panel 25 and front panel 31 are drawn to bend or curve toward one another such that the top portions 43, 45 are disposed in an oblique arrangement relative to respective bottom portions 47, 48 of the respective back panel 25 and front panel 31.

In this regard, the central gusset panels 81, 91 are positioned in an inwardly spaced arrangement with respect to the respective lower portions 30, 34 of the respective side panels 27, 37. Such positioning of the gussets 79, 88 can be accomplished, for example, by drawing or "pinching" the back panel 25 and the front panel 31 toward one another such that the gussets 79, 88 are activated as described above. In one embodiment, such activation of the gussets 79, 88 can occur directly, for example, by manual engagement of one or more portions of the gussets 79, 88 by a user, or, in another embodiment, through indirect activation by the approximation or pinching of the back panel 25 and the front panel 31 toward one another. In the exemplary embodiment shown, activation of the gussets 79, 88 results in at least partial folding of the second and third gusset panels 83, 85 relative to the central panel 81 at the respective fold lines 84, 86 and at least partial folding of the fifth and sixth gusset panels 93, 95 relative to the central panel 91 at respective fold lines 94, 96. Further, the second and third gusset panels 83, 85 are at least partially folded relative to the respective front and back panels 25, 31 at portions of respective fold lines 29, 33 and the fifth and sixth gusset panels 93, 95 are at least partially folded relative to the respective front and back panels 31, 25 at respective fold lines 39, 45. As shown, the central panels 81, 91 are also at least partially folded relative to the respective lower portions 30, 34 of the respective first and second side panels 27, 37 at respective fold lines 82, 92. The gusset panels 83, 95 overlap and are in at least partial face-to-face contact with the back panel 25 and the gusset panels 85, 93 overlap and are in at least partial face-to-face contact with the front panel 31.

Figure 4:
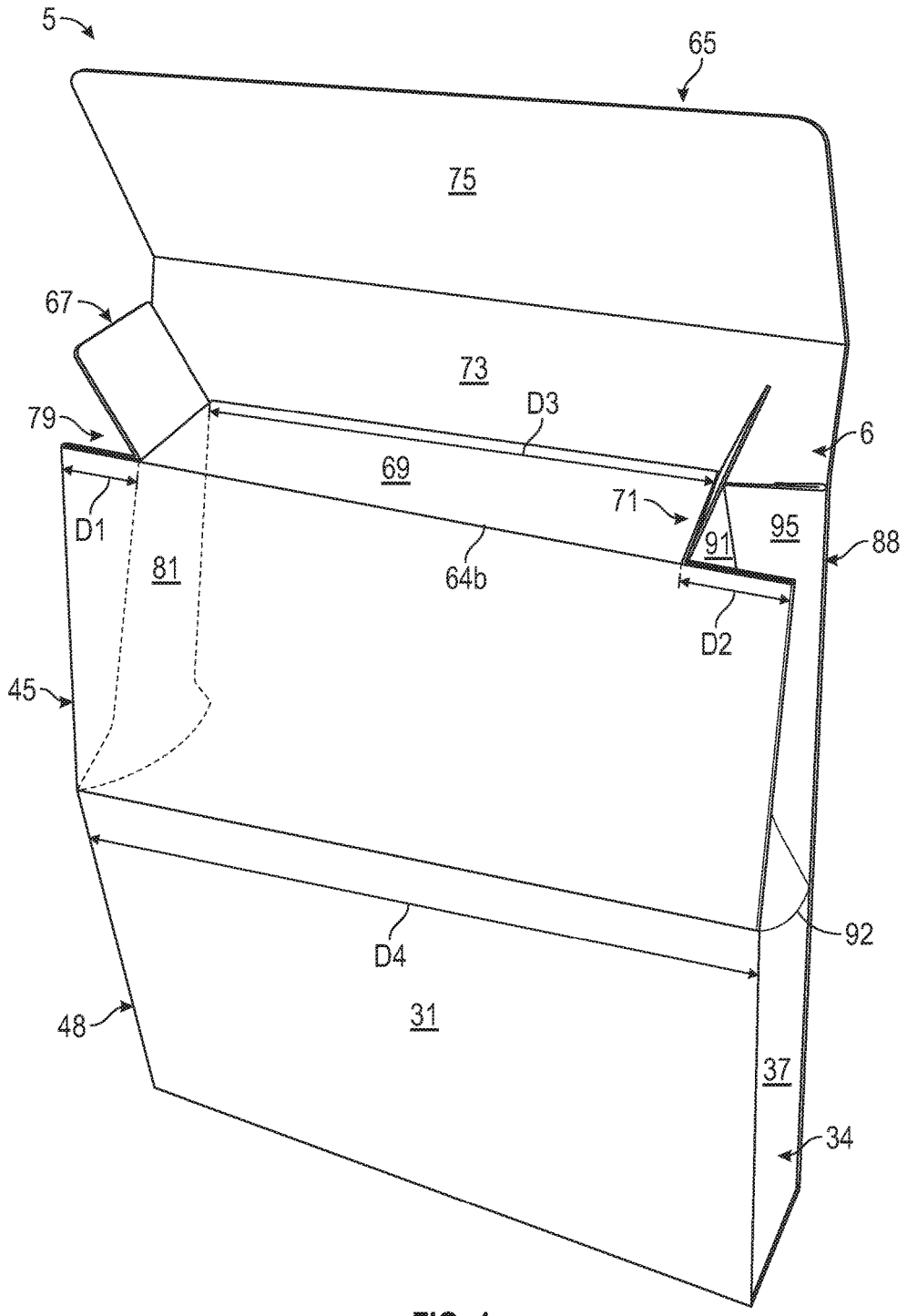
FIG. 4 is a first sequential view of the carton of FIG. 3 during a closing operation according to one exemplary embodiment of the disclosure.
Figure 5:
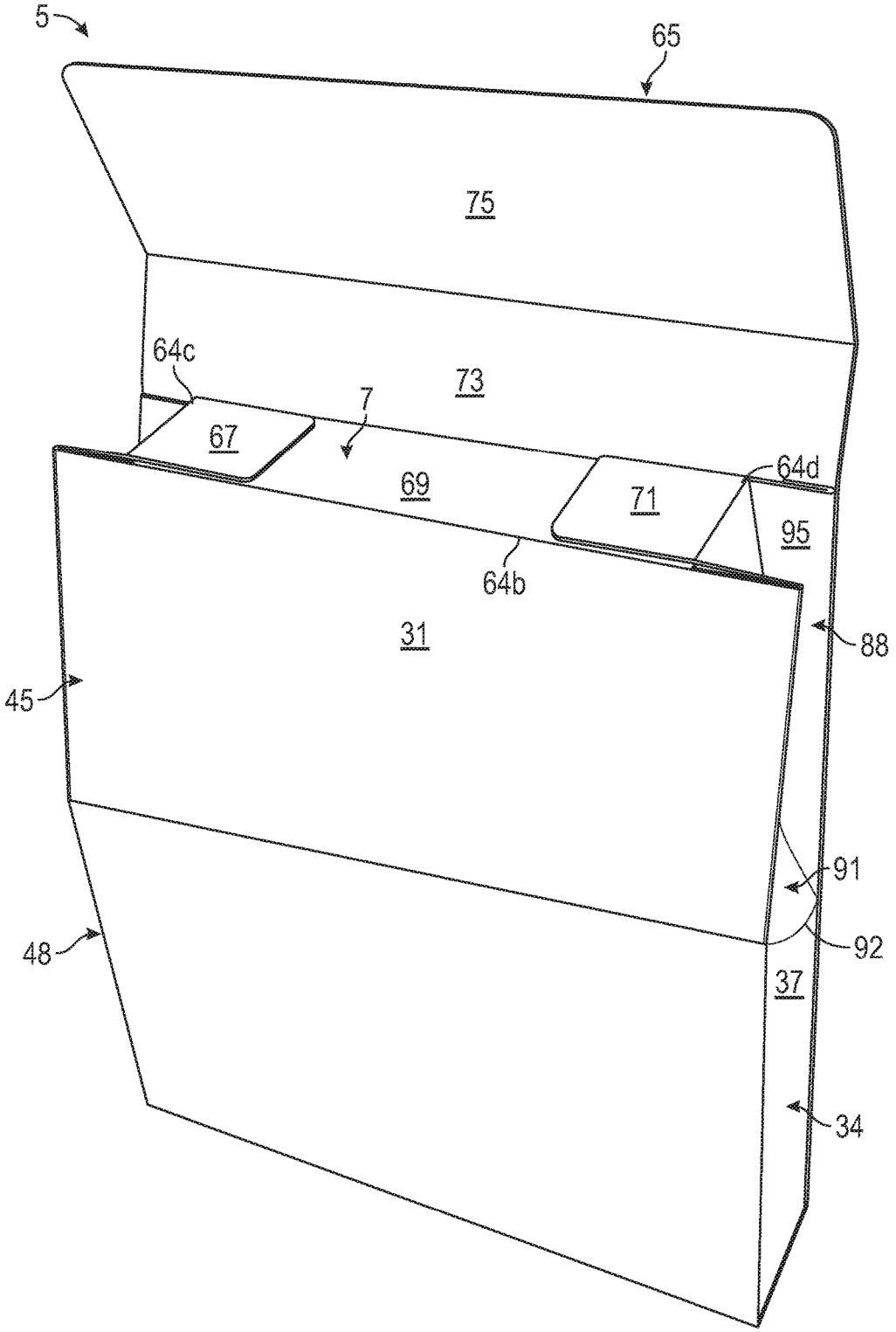
FIG. 5 is a second sequential view of the carton of FIG. 3 during a closing operation according to one exemplary embodiment of the disclosure.

As shown in FIGS. 4 and 5, the top end flaps 67, 69, 71 can be folded at respective portions 64*b*, 64*c*, 64*d* of the longitudinal fold line 64 toward the interior 6 of the carton 5 to provide a first closure 7 of the interior 6 of the carton 5. One or more portions of the gussets 79, 88 adjacent the respective flaps 67, 71 also cooperate to form the first closure 7. The first closure 7 provides a seal at the top of the front panel 31, the first side panel 27, the second side panel 37, and the back panel 25. In the illustrated embodiment, the top end flap 69 can first be folded downwardly at the portion 64*b* of the longitudinal fold line 64 and the end flaps 67, 71 can then be folded downwardly at respective portions 64*c*, 64*d* of the longitudinal fold line 64 to at least partially overlap the top end flap 69 in at least partial face-to-face contact, which, in addition to portions of the adjacent gussets 79, 88, provide the first closure 7 that closes the interior 6 of the carton 5. The end flaps 67, 71 can be secured to the top end flap 69, for example, with an adhesive such as glue. In one embodiment, the first closure 7 includes the gusset panels 83, 95 in at least partial face-to-face contact with the back panel 25 and the gusset panels 85, 93 in at least partial face-to-face contact with the front panel 31 to seal or otherwise prevent product P from passing through the top of the gussets 79, 88.

Figure 6:
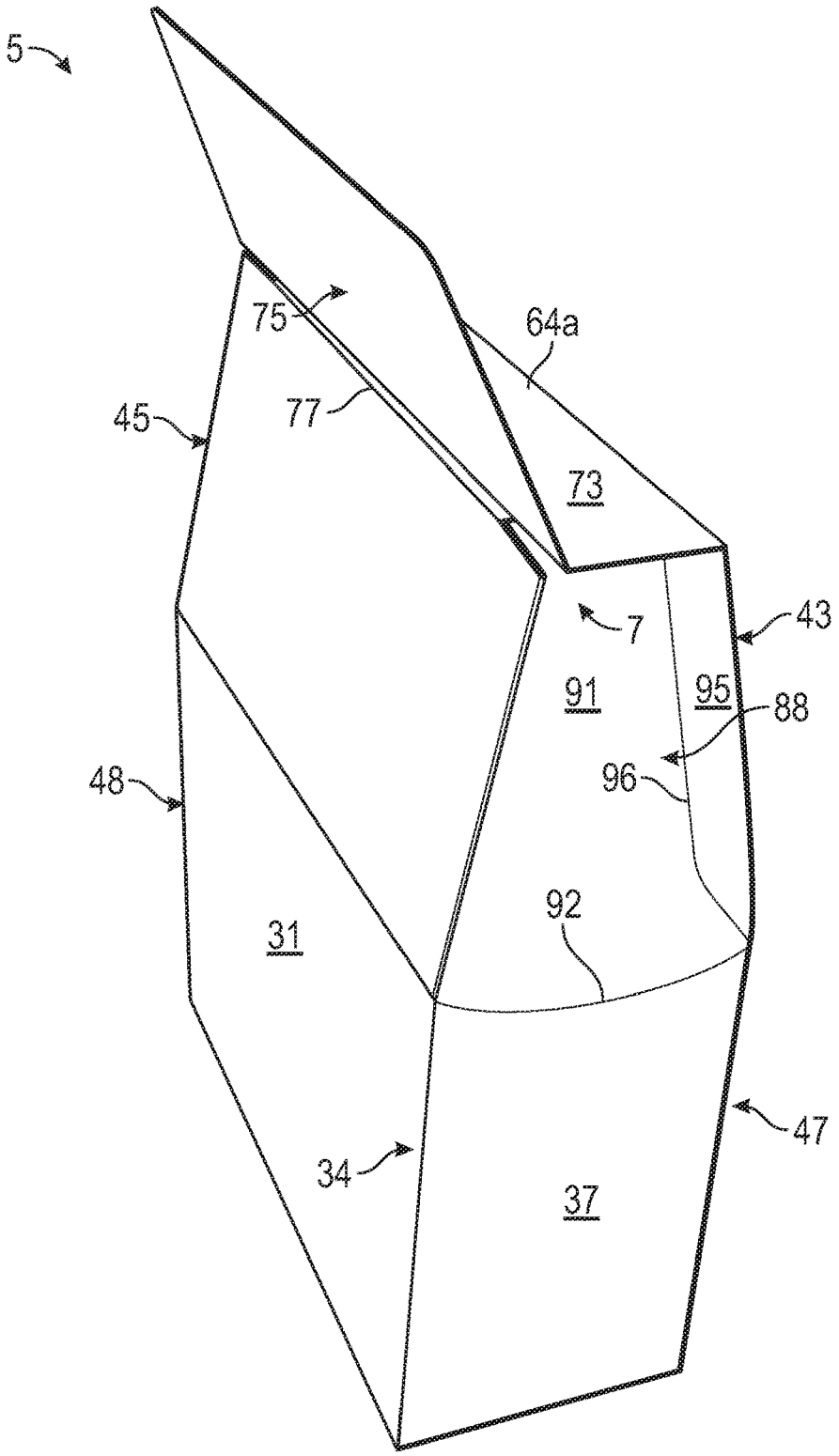
FIG. 6 is a third sequential view of the carton of FIG. 3 during a closing operation according to one exemplary embodiment of the disclosure.

Referring to FIG. 6, the proximal portion 73 of the end flap 65 can be folded downwardly at the portion 64*a* of the longitudinal fold line 64 to overlap and be in at least partial face-to-face contact with the first closure 7 formed by the end flaps 67, 69, 71 and the gussets, 79, 88, as shown. In such an arrangement, the proximal portion 73 overlaps and is in at least partial face-to-face contact with the end flaps 67, 69, 71 and is substantially parallel to the bottom 11 of the carton 5. As shown in FIG. 7, the distal portion 75 of the end flap 65 can be folded downwardly at fold line 77 to overlap the front panel 31 in at least partial face-to-face contact such that the proximal and distal portions 73, 75 of the end flap 65 at least partially overlap and/or envelop, e.g., at least partially extend past or overhang, the first closure 7. The distal portion 75 of the end flap 65 may be maintained in face-to-face contact with the front panel 31, for example, with an adhesive such as glue. In other embodiments, one or more interlocking features, for example, tabs and slots, can be provided to one or both of the distal portion 75 of the end flap 65 and the front panel 31 to maintain face-to-face contact thereof.

Figure 8:
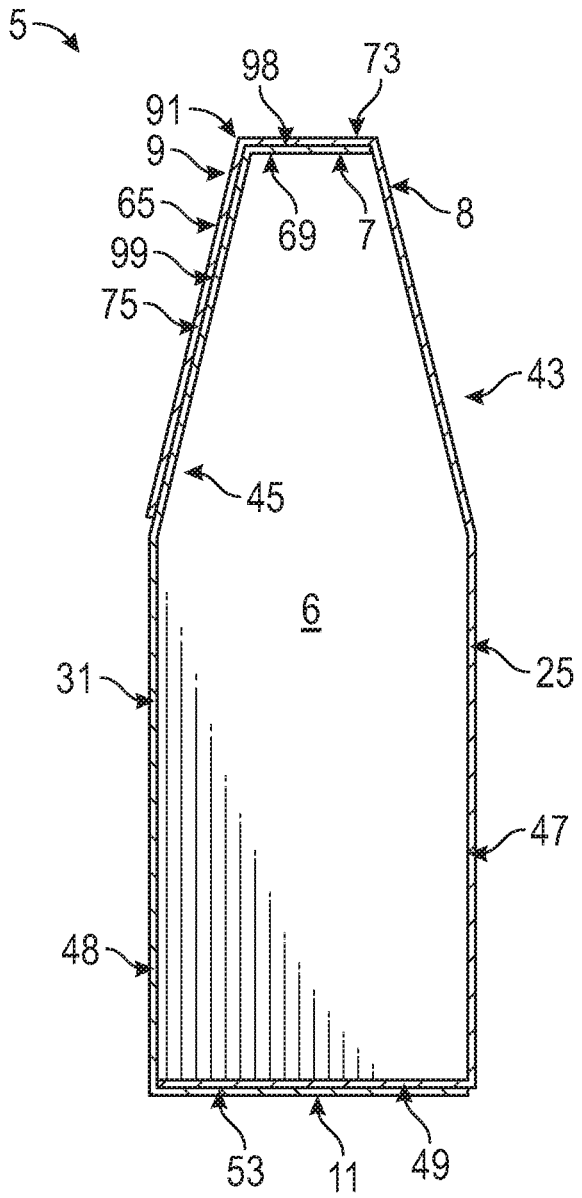
FIG. 8 is a cross-sectional view taken along line 8-8 of FIG. 7.

Turning additionally to FIG. 8, in a closed condition, the carton 5 provides the first closure 7 being at least partially overlapped and/or enveloped by the end flap 65 such that the end flap 65 provides a second closure 9 of the carton 5. In particular, the distal portion 75 of the end flap 65 extends past any margins, seams, and/or gaps associated with the first closure 7, for example, between top end flaps 67, 69, 71, such that particulate, for example, fragmentary or smaller pieces of flowable products P are maintained within the interior 6 of the carton 5. In this regard, the second closure 9 also provides a seal at the top of the front panel 31, the first side panel 27, the second side panel 37, and the back panel 25. Referring additionally to the cross-sectional view of FIG. 8, the positioning of the end flap 65 to overlap the closure 7 may provide one or more serpentine, torturous, or otherwise segmented pathways defined between portions of the first closure 7 and portions of the second closure 9 that inhibit the passage and/or exit of particulate from the interior 6 of the carton 5 in addition to the first closure 7. Such pathways may be sealed, for example, by the at least partial face-to-face contact of portions of the first closure 7 and the second closure 9, and such sealing can be reinforced, for example, with an adhesive such as glue. In the exemplary embodiment shown, sealed pathways 98, 99 can be defined between the respective portions 73, 75 of the end flap 65 and the respective end flap 69 and front panel 31. Further, the continuous configuration of gussets 79, 88 provides a folded configuration of the carton 5 that minimizes the presence of discontinuities adjacent the interior 6 of the carton 5, for example, margins, seams, and/or gaps between adjacent panels and/or flaps. The proximal portion 73 of the end flap 65 extends across the top of the gusset panels 95, 83 that are in at least partial face-to-face contact with the back panel 25 and the top of the gusset panels 85, 93 that are in at least partial face-to-face contact with the front panel 31. When the distal portion 75 of the end flap 65 is downwardly folded the tops of the gussets 79, 88 are sealed to prevent material from passing from the interior 6 through any space between the gusset panels 95, 83 and the back panel 25 and the gusset panels 85, 93 and the front panel 31.

Accordingly, and as described herein, the carton 5 incorporates the first closure 7, the second closure 9 that at least partially overlaps the first closure 7, and the gussets 79, 88 such that the carton 5 provides a sift-proof or sift-minimizing configuration to inhibit, minimize, and/or prevent the passage of flowable products P (e.g., granular or powdered products) or associated particulate from within the interior 6 of the carton 5. Such configuration may be desirable, for example, in the case of smaller food products or other flowable products P, easily frangible food products P, and/or in instances in which carton 5 may be subject to movement or jostling. In one embodiment, such configuration can provide a substantially sealed, e.g., hermetically sealed, condition of the gable top 8 of the carton 5. Further still, the tapered configuration of the gable top 8 of the carton 5 (including the flat, planar configuration of the proximal portion 73 of end flap 65) provides a visually-distinctive carton configuration that can be readily identified among other cartons or packages.

The carton 5 could include various handle features for carrying the carton and could include various dispenser features for opening the carton. Further, the carton 5 could include other panel/flap closing configurations without departing from the disclosure. In one embodiment, the carton 5 can include a liner for maintaining food products P (FIG. 3) therein.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels that extends at least partially around an interior of the carton, the plurality of panels comprises a front panel, a first side panel, a second side panel, and a back panel;

a plurality of end flaps foldably connected to respective panels of the plurality of panels, the plurality of end flaps comprises a first end flap foldably connected to the front panel, a second end flap foldably connected to the back panel, a third end flap foldably connected to the first side panel, and a fourth end flap foldably connected to the second side panel; and a first gusset foldably connected to a portion of the first side panel and a second gusset foldably connected to a portion of the second side panel, the first end flap, the third end flap, the fourth end flap, the first gusset, and the second gusset cooperate such that the third end flap and the fourth end flap overlap the first end flap to form a first closure of the carton, the first closure provides a first seal at the top of the front panel, the first side panel, the second side panel, and the back panel, and the second end flap forms a second closure of the carton, the second closure at least partially overlaps and at least partially envelops the first closure and provides a second seal at the top of the front panel, the first side panel, the second side panel, and the back panel.

2. The carton of claim 1, wherein the second end flap comprises a proximal portion foldably connected to a distal portion.

3. The carton of claim 2, wherein the proximal portion of the second end flap at least partially overlaps the first end flap, and the distal portion of the second end flap at least partially overlaps the front panel.

4. The carton of claim 2, wherein a portion of the first gusset is disposed inwardly toward the interior of the carton a first longitudinal distance, a portion of the second gusset is disposed inwardly toward the interior of the carton a second longitudinal distance, the first end flap has a length equal to a third longitudinal distance, and the front panel has a length equal to a fourth longitudinal distance, and the sum of the first longitudinal distance, the second longitudinal distance, and the third longitudinal distance is substantially equal to the fourth longitudinal distance.

5. The carton of claim 1, wherein an upper portion of the front panel is obliquely disposed relative to a lower portion of the front panel and an upper portion of the back panel is obliquely disposed relative to a lower portion of the back panel.

6. The carton of claim 5, wherein the second end flap comprises a proximal portion foldably connected to a distal portion, the distal portion of the second end flap is at least partially in face-to-face contact with the upper portion of the front panel.

7. The carton of claim 1, wherein the first gusset comprises a first gusset panel, a second gusset panel, and a third gusset panel.

8. The carton of claim 7, wherein the first gusset panel is foldably connected to each of the second gusset panel and the third gusset panel.

9. The carton of claim 8, wherein the first gusset panel is foldably connected to the second gusset panel by a first fold line having a first oblique portion intersecting a second oblique portion, and the first gusset panel is foldably connected to the third gusset panel by a second fold line having a first oblique portion and a second oblique portion.

10. The carton of claim 9, wherein the second oblique portion of the first fold line and the second oblique portion of the second fold line are interconnected by a curved fold line.

11. The carton of claim 10, wherein the second gusset comprises a fourth gusset panel, a fifth gusset panel, and a sixth gusset panel, the fourth gusset panel is foldably connected to the fifth gusset panel at a third fold line and the fourth gusset panel is foldably connected to the sixth gusset panel at a fourth fold line, each of the third fold line and the fourth fold line comprises a first oblique portion intersecting a second oblique portion, the second oblique portion of the third fold line and the second oblique portion of the fourth fold line are interconnected by a curved fold line.

12. The carton of claim 1, wherein each of the first end flap, the third end flap, and the fourth end flap is generally perpendicularly folded at the respective front panel, first side panel, and second side panel to at least partially form a flat gable top of the carton.

13. A blank for forming a carton for holding at least one article, the blank comprising:

a plurality of panels for extending at least partially around an interior of the carton formed from the blank, the plurality of panels comprises a front panel, a first side panel, a second side panel, and a back panel;

a plurality of end flaps foldably connected to respective panels of the plurality of panels, the plurality of end flaps comprises a first end flap foldably connected to the front panel, a second end flap foldably connected to the back panel, a third end flap foldably connected to the first side panel, and a fourth end flap foldably connected to the second side panel; and a first gusset foldably connected to a portion of the first side panel and a second gusset foldably connected to a portion of the second side panel, the first end flap, the third end flap, the fourth end flap, the first gusset, and the second gusset are for cooperating such that the third end flap and the fourth end flap overlap the first end flap to form a first closure of the carton formed from the blank, the first closure provides a first seal at the top of the front panel, the first side panel, the second side panel, and the back panel when the carton formed from the blank, and the second end flap is for forming a second closure of the carton formed from the blank, the second closure is for at least partially overlapping and at least partially enveloping the first closure of the carton formed from the blank and providing a second seal at the top of the front panel, the first side panel, the second side panel, and the back panel when the carton is formed from the blank.

14. The blank of claim 13, wherein the second end flap comprises a proximal portion foldably connected to a distal portion.

15. The blank of claim 14, wherein the proximal portion of the second end flap at least partially overlaps the first end flap when the carton is formed from the blank, and the distal portion of the second end flap at least partially overlaps the front panel when the carton is formed from the blank.

16. The blank of claim 14, wherein a portion of the first gusset is disposed inwardly toward the interior of the carton formed from the blank a first longitudinal distance, a portion of the second gusset is disposed inwardly toward the interior of the carton formed from the blank a second longitudinal distance, the first end flap has a length equal to a third longitudinal distance, and the front panel has a length equal to a fourth longitudinal distance, and the sum of the first longitudinal distance, the second longitudinal distance, and the third longitudinal distance is substantially equal to the fourth longitudinal distance.

17. The blank of claim 13, wherein an upper portion of the front panel is obliquely disposed relative to a lower portion of the front panel and an upper portion of the back panel is obliquely disposed relative to a lower portion of the back panel when the carton is formed from the blank.

18. The blank of claim 17, wherein the second end flap comprises a proximal portion foldably connected to a distal portion, the distal portion of the second end flap is at least partially in face-to-face contact with the upper portion of the front panel when the carton is formed from the blank.

19. The blank of claim 13, wherein the first gusset comprises a first gusset panel, a second gusset panel, and a third gusset panel.

20. The blank of claim 19, wherein the first gusset panel is foldably connected to each of the second gusset panel and the third gusset panel.

21. The blank of claim 20, wherein the first gusset panel is foldably connected to the second gusset panel by a first fold line having a first oblique portion intersecting a second oblique portion, and the first gusset panel is foldably connected to the third gusset panel by a second fold line having a first oblique portion and a second oblique portion.

22. The blank of claim 21, wherein the second oblique portion of the first fold line and the second oblique portion of the second fold line are interconnected by a curved fold line.

23. The blank of claim 22, wherein the second gusset comprises a fourth gusset panel, a fifth gusset panel, and a sixth gusset panel, the fourth gusset panel is foldably connected to the fifth gusset panel at a third fold line and the fourth gusset panel is foldably connected to the sixth gusset panel at a fourth fold line, each of the third fold line and the fourth fold line comprises a first oblique portion intersecting a second oblique portion, the second oblique portion of the third fold line and the second oblique portion of the fourth fold line are interconnected by a curved fold line.

24. The blank of claim 13, wherein each of the first end flap, the third end flap, and the fourth end flap is for being generally perpendicularly folded at the respective front panel, first side panel, and second side panel to at least partially form a flat gable top of the carton formed from the blank.

25. A method of forming a carton for holding at least one article, the method comprising:

obtaining a blank comprising a plurality of panels and a plurality of end flaps, the plurality of panels comprises a front panel, a first side panel, a second side panel, and a back panel, the plurality of end flaps are foldably connected to respective panels of the plurality of panels, the plurality of end flaps comprises a first end flap foldably connected to the front panel a second end flap foldably connected to the back panel, a third end flap foldably connected to the first side panel, and a fourth end flap foldably connected to the second side panel, the blank comprises a first gusset foldably connected to a portion of the first side panel and a second gusset foldably connected to a portion of the second side panel; and folding the plurality of panels to at least partially extend around an interior of the carton;

positioning the first end flap, the third end flap, the fourth end flap, the first gusset, and the second gusset such that the third end flap and the fourth end flap overlap the first end flap to form a first closure of the carton, the first closure provides a first seal at the top of the front panel, the first side panel, the second side panel, and the back panel; and positioning the second end flap to form a second closure of the carton, the second closure at least partially overlaps and at least partially envelops the first closure and provides a second seal at the top of the front panel, the first side panel, the second side panel, and the back panel.

26. The method of claim 25, wherein the second end flap comprises a proximal portion foldably connected to a distal portion.

27. The method of claim 26, wherein the proximal portion of the second end flap at least partially overlaps the first end flap, and the distal portion of the second end flap at least partially overlaps the front panel.

28. The method of claim 26, wherein a portion of the first gusset is disposed inwardly toward the interior of the carton a first longitudinal distance, a portion of the second gusset is disposed inwardly toward the interior of the carton a second longitudinal distance, the first end flap has a length equal to a third longitudinal distance, and the front panel has a length equal to a fourth longitudinal distance, and the sum of the first longitudinal distance, the second longitudinal distance, and the third longitudinal distance is substantially equal to the fourth longitudinal distance.

29. The method of claim 25, wherein an upper portion of the front panel is obliquely disposed relative to a lower portion of the front panel and an upper portion of the back panel is obliquely disposed relative to a lower portion of the back panel.

30. The method of claim 29, wherein the second end flap comprises a proximal portion foldably connected to a distal portion, the distal portion of the second end flap is at least partially in face-to-face contact with the upper portion of the front panel.

31. The method of claim 25, wherein the first gusset comprises a first gusset panel, a second gusset panel, and a third gusset panel.

32. The method of claim 31, wherein the first gusset panel is foldably connected to each of the second gusset panel and the third gusset panel.

33. The method of claim 32, wherein the first gusset panel is foldably connected to the second gusset panel by a first fold line having a first oblique portion intersecting a second oblique portion, and the first gusset panel is foldably connected to the third gusset panel by a second fold line having a first oblique portion and a second oblique portion.

34. The method of claim 33, wherein the second oblique portion of the first fold line and the second oblique portion of the second fold line are interconnected by a curved fold line.

35. The method of claim 34, wherein the second gusset comprises a fourth gusset panel, a fifth gusset panel, and a sixth gusset panel, the fourth gusset panel is foldably connected to the fifth gusset panel at a third fold line and the fourth gusset panel is foldably connected to the sixth gusset panel at a fourth fold line, each of the third fold line and the fourth fold line comprises a first oblique portion intersecting a second oblique portion, the second oblique portion of the third fold line and the second oblique portion of the fourth fold line are interconnected by a curved fold line.

36. The method of claim 25, further comprising generally perpendicularly folding each of the first end flap, the third end flap, and the fourth end flap at the respective front panel, first side panel, and second side panel to at least partially form a flat gable top of the carton.

* * * * *